United States Patent [19]

Bunger et al.

[11] 4,165,030

[45] Aug. 21, 1979

[54] TWO CELL BULK BOX

[75] Inventors: Arthur W. Bunger, Savannah, Ga.; Thorne C. Kitchell, Spartanburg, S.C.

[73] Assignee: Union Camp Corporation, Wayne, N.J.

[21] Appl. No.: 916,512

[22] Filed: Jun. 19, 1978

[51] Int. Cl.[2] ..... B65D 3/24; B65D 5/48

[52] U.S. Cl. ..... 229/15; 229/27; 229/23 R

[58] Field of Search ..... 229/15, 27, 28, 23 BT

[56] References Cited

U.S. PATENT DOCUMENTS

| | | | |
|---|---|---|---|
| 3,066,842 | 12/1962 | Croley | 229/7 R |
| 3,347,446 | 10/1967 | Guyer et al. | 229/27 |
| 3,404,806 | 10/1968 | Richardson | 229/27 X |
| 3,425,615 | 2/1969 | Wood | 229/15 |
| 3,543,991 | 12/1970 | George et al. | 229/28 X |
| 3,904,105 | 9/1975 | Booth | 229/15 |
| 4,037,775 | 7/1977 | Bamburl et al. | 229/15 |
| 4,091,983 | 5/1978 | Booth et al. | 229/15 |
| 4,094,455 | 6/1978 | Bamburl et al. | 229/23 BT X |
| 4,406,307 | 9/1978 | Booth et al. | 229/15 |

*Primary Examiner*—Davis T. Moorhead

*Attorney, Agent, or Firm*—Kane, Dalsimer, Kane, Sullivan and Kurucz

[57] ABSTRACT

A box having inner and outer pieces secured together to form two cells with the ends of the two inner pieces laminated together in hooked relationship to form a center strut tying together the opposite sides of the box.

4 Claims, 7 Drawing Figures

TWO CELL BULK BOX

BACKGROUND OF THE INVENTION

1. Field of the Invention

The invention relates to bulk material boxes, and more particularly to boxes formed from corrugated board for shipping and storing bulk materials such as peanuts.

2. Description of the Prior Art

The prior art discloses many containers of corrugated board which are used for shipping and storing bulk materials because of their light weight and low cost as well as their capability of being knocked down or folded when empty so that they can be stored or shipped when empty in flat condition in a minimum of space. Such containers must be sufficiently strong to hold relatively large weights of bulk material without bulging and to permit stacking of the containers without failure of the container walls. Containers of this type with multi-cells or tubes laminated together are shown in U.S. Pat. Nos. 3,425,615, 3,543,991, 3,904,105, 4,046,307, and 4,037,775. Containers of this type with tubular liners are shown in U.S. Pat. Nos. 3,066,842, 3,633,794, 3,701,466 and 3,715,072. Other types of containers with partitions or panels are shown in U.S. Pat. Nos. 3,347,446 and 3,404,806.

The box of the present invention is an improvement over such prior art containers.

SUMMARY OF THE INVENTION

The invention comprises a two cell bulk box body which comprises:

a pair of tubes positioned adjacent to each other each formed from four serially interconnected panels to provide first side, end, second side, and center inner walls;

the center inner walls of the tubes being interlocked and bonded inside face to inside face to provide a center strut for the box;

the first side wall of each tube having an extended end which overlaps and is bonded to the second side wall of the other tube and over the end of the said strut; and a pair of members each encasing a tube and formed from three serially interconnected panels to provide first side, end, and second side outer walls;

the first side wall of each member having its end meeting the extended end of the first wall of the opposite inner tube;

the second side wall of each member having an extended end which overlaps and is bonded over the said meeting ends of its encased tube and the opposite member.

The invention also comprises the method of combining the tube and member sheets into a folded flat blank which can be set up to form the two cell bulk box body of the present invention.

DETAILED DESCRIPTION OF THE PREFERRED EMBODIMENTS OF THE INVENTION

Figure 1:
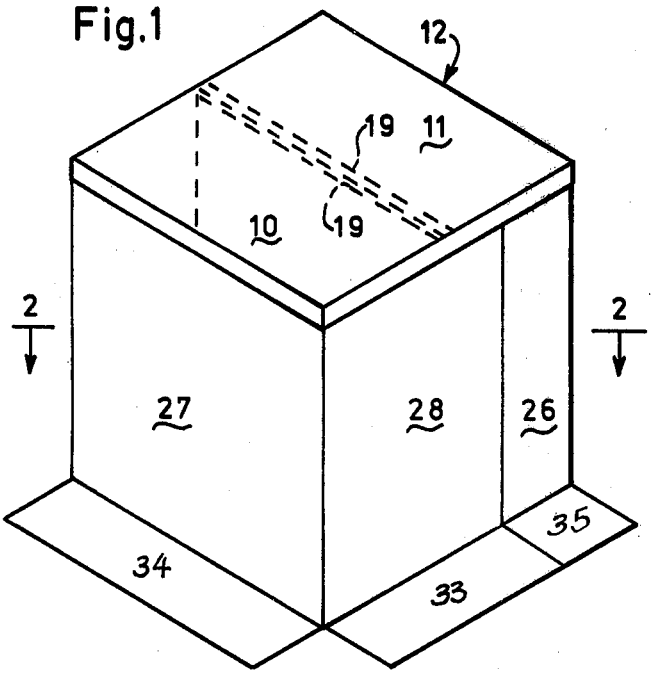
FIG. 1 is a perspective view of the two cell bulk box of the present invention.

Referring to the drawings, there is shown in FIG. 1 a bulk box including a body formed of two cells 10 and 11 and top closing means such as a top cap 12. The top cap is a conventional top cap utilized in prior art material boxes, but could be replaced by any other top closing lid or arrangement. For the bottom a conventional support, such as a pallet, bottom cap, or the like, with or without a slip sheet, can be used.

Figure 2:
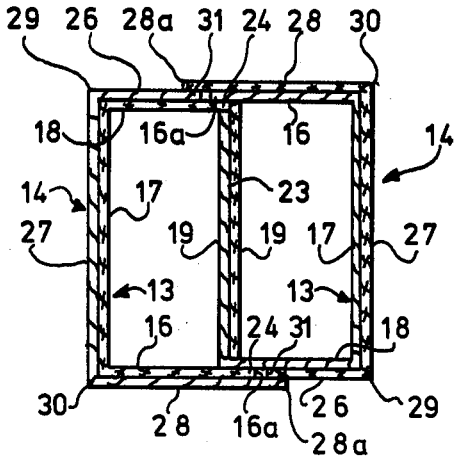
FIG. 2 is a cross-sectional view along the line 2—2 of FIG. 1.

Referring to FIG. 2, each cell of the box body is formed from an inner tube 13 and an encasing outer member 14. Each may be made of a substantially rectangular sheet of corrugated paperboard, fibreboard, or the like, of a weight suitable to support the material to be packaged.

Figure 3:
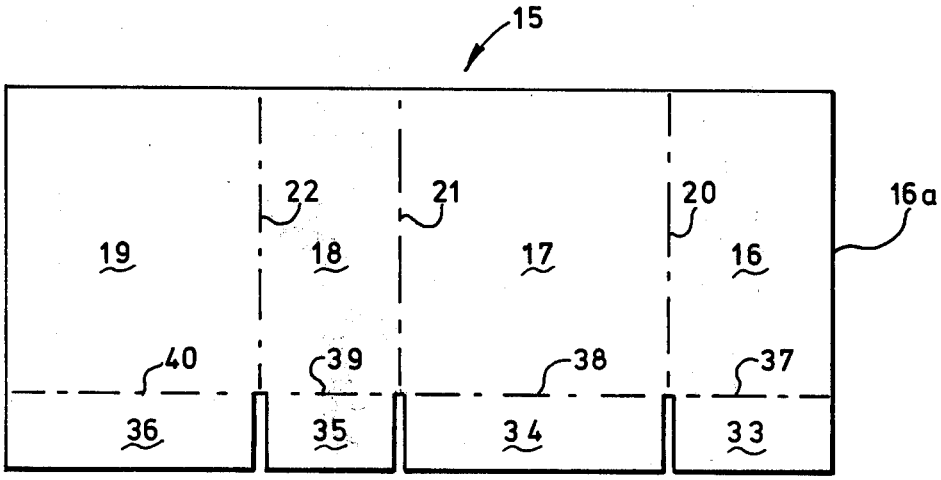
FIG. 3 is a plan view of the blank for forming each of the two inner tubes of the box of FIG. 1.
Figure 4:
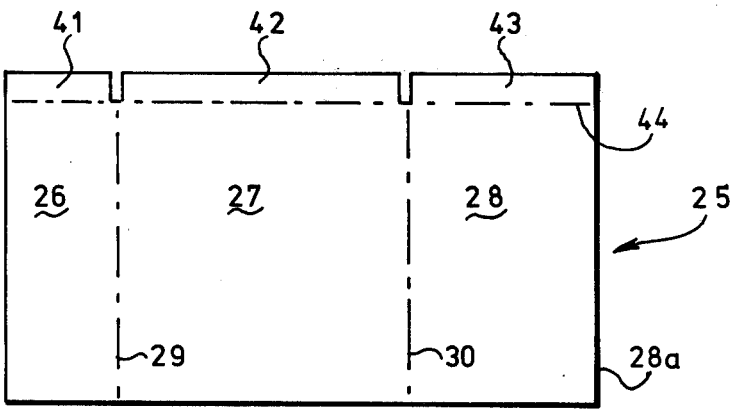
FIG. 4 is a plan view of the blank for forming each of the two outer members of the box of FIG. 1.

Each sheet 15 for each tube 13 (FIG. 3) consists of a first side inner wall 16, an end inner wall 17, a second side inner wall 18, and a center inner wall 19. These walls are serially interconnected along score lines 20, 21, and 22. In the box body the center inner walls 19 of two sheets 15 are interlocked in hooked relationship and bonded together with adhesive 23 inside face to inside face to form the center strut of the box (FIG. 2). The first side inner wall 16 of each tube has an extended end **16*a* so that such end will overlap and can be bonded with adhesive 24 to the outer surface of the second side wall 18** of the other tube. Accordingly, such extended end of each tube will overlie the end of the said strut and further serve to lock the tubes together adjacent to each other.

Each sheet 25 for each outer member encasing a tube consists of a first side outer wall 26, an end outer wall 27, and a second side outer wall 28. These walls are serially interconnected along score lines 29 and 30. In the box body the first side wall 26 is of shortened length so that its outer edge meets the outer edge of the extended end **16*a* of the first inner wall 16 of the opposite inner tube (FIG. 2). The second side outer wall 28 of each member has an extended end 28*a* so that such end will overlap and can be bonded with adhesive 31** over the said meeting ends of the encased tube and the opposite member.

It will be apparent that the interlocking and bonding of the walls forming the center strut of the box and the bonding of the ends of the various walls over the meeting joints of the walls and the ends of the strut effectively ties together the tubes and encasing members into an integral unit. Such box is much stronger than any containers or boxes of the prior art.

Figure 5:
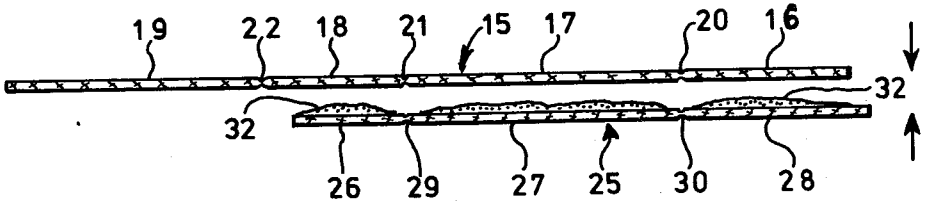
FIG. 5 is a cross-sectional view from the top edge showing how a tube blank of FIG. 3 is laminated to a member blank of FIG. 4 to provide a combined inner tube and its encasing outer member.
Figure 6:
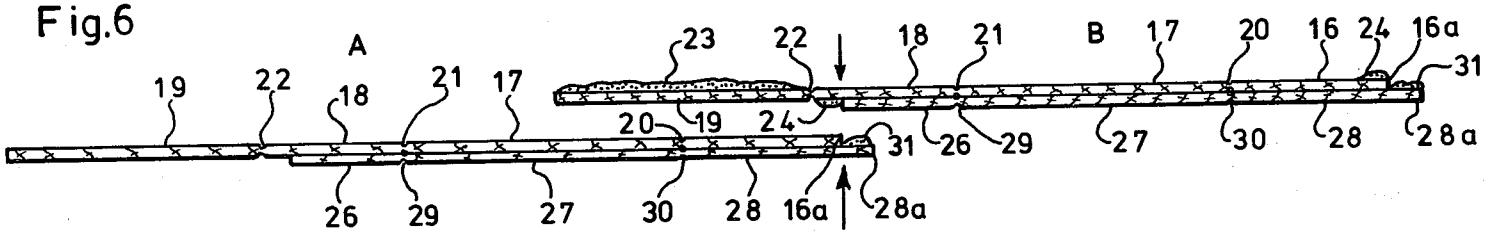
FIG. 6 is a top edge view showing how a combined inner tube and its encasing outer member of FIG. 5 is laminated to a second combined inner tube and its encasing member of FIG. 5.
Figure 7:
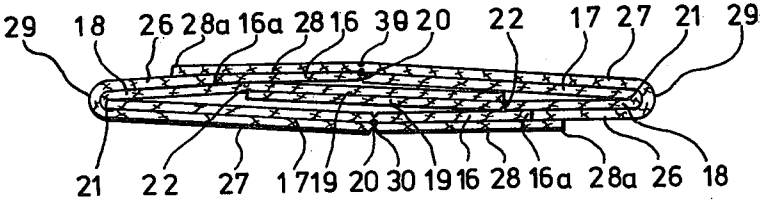
FIG. 7 is a cross-sectional view from the top edge showing the laminated combined inner tubes and encasing outer members folded with the ends secured to form a flat blank which can be set up to form the two cell bulk box body of the present invention.

FIGS. 5, 6, and 7 illustrate how the sheets for the tubes and encasing member can be combined and laminated together to form a folded flat blank which can be set up to form the two cell bulk box body of the present invention. In the first step a sheet 15 for the outer tube 13 (FIG. 3) is laminated with adhesive 32 to a sheet 25 for the outer encasing member 14 as shown in FIG. 5. The score lines 21 and 20 of sheet 15 are alined with the score lines 29 and 30, respectively, of the sheet 25. Thus walls 18, 17, and 16 of sheet 15 are superimposed and bonded respectively to walls 26, 27, and 28 of sheet 25. Similarly, a second sheet 15 is laminated to a second sheet 25 so that there are the two combined forms of the structure shown in FIG. 5.

In the second step the two combined forms of FIG. 5 are brought together to form the single unit of FIG. 6. The two combined forms designated A and B are placed end to end with the extended end 16*a* of form A butting against the end of shortened wall 26 of form B. Adhesive 31 has been applied to the extended end 28*a* of form A so that when the two forms are butted together such extended end 28*a* of form A will be bonded over the meeting ends of the said end 16*a* of form A and the end of wall 26 of form B.

In the final step adhesive 23 is applied to the top surface of inner wall 19 of form B and adhesive 31 is applied to the extended end 28*a* of form B. The single unit of FIG. 6 isfirst folded on the alined score lines 21–29 of form A to superimpose the top surface of inner walls 19 of form A over the top surface of the inner wall 19 of form B, thus bonding such surfaces together. The unit of FIG. 6 is then folded on the alined score lines 21–29 of form B which brings the extended end 16*a* of form B into butting relationship with the end of shortened wall 26 of form A. The adhesive 31 on the extended end 28*a* of form B will bond such extended end over the meeting ends of the said end 16*a* of form B and the end of wall 26 of form A. This results in a folded flat blank (FIG. 7) which can be set up to form the two cell bulk box body of the present invention.

It will be noted that there are only two locations (lines 21–29 of forms A and B) where the cell walls of the box are folded back on themselves during fabrication. The fewer fold backs the easier to manufacture. Furthermore, there are a maximum of six thicknesses of corrugated board in the design of the blank for the box of the present invention.

Bottom flaps 33, 34, 35, and 36, which are optional, may be connected to the inner walls 16, 17, 18, and 19, respectively, along hinge score lines 37, 38, 39, and 40. Such flaps are attached to the inner cell of the box thereby preventing items packed in the box from becoming trapped on the raw edges of board as is possible on box made from flaps on outside tubes or cells. Instead of the bottom flaps shown, it will be understood that other forms of bottom closures or flaps may be used, i.e. plain regular slotted, diagonally scored-bellows (sift proof), or overlap flaps. The box may also have slit-slots to make tight corners.

Similarly top flanges 41, 42, and 43 are connected to the outer walls 26, 27, and 28, respectively of each member along hinge score lines 44, 45, and 46. The width of such flanges may be varied to suit particular needs. Such flaps are attached to the outer member of the box. When the sheets are assembled to form the box blank the end of the flange 41 of one member and the flange 43 of the other member may be overlapped and glued thus forming continuous flanges along the sides of the box. This is possible because of the extended ends 28*a*. By such flange arrangement, flanges may be interlocked into a closed position thus making it unnecessary to tape or stitch down flanges to facilitate placement of cap on the box. If desired, the raw edges at the top of the box may be covered by the application of tape in the manufacture of the corrugated board or in a separate operation.

Those skilled in the art will appreciate that many variations of the above described embodiment of the invention may be made without departing from the spirit and scope of the invention.

What is claimed:

1. A two cell bulk box body comprising:

a pair of tubes positioned adjacent to each other each formed from four serially interconnected panels to provide first side, end, second side, and center inner walls;

the center inner walls of the tubes being interlocked and bonded inside face to inside face to provide a center strut for the box;

the first side wall of each tube having an extended end which overlaps and is bonded to the second side wall of the other tube and over the end of the said strut;

a pair of members each encasing a tube and formed from three serially interconnected panels to provide first side, end, and second side outer walls;

the first side wall of each member having its end meeting the extended end of the first wall of the opposite inner tube;

the second side wall of each member having an extended end which overlaps and is bonded over the said meeting ends of the encased tube and the opposite member.

2. The box body of claim 1 wherein top flanges are connected respectively to the first side, end, and second side outer walls of each said member, with the ends of the flanges connected to the first sides of the members and the ends of the flanges connected to the second sides of the members overlapped and glued to form continuous flanges along the sides of the box.

3. The box body of claim 1 wherein bottom flaps are connected respectively to the first side, end, and second side inner walls of each inner tube, whereby when the said flaps are folded downwardly into a horizontal position items packed in the box will be prevented from becoming trapped on the raw edges of the board of the outer walls.

4. The method of forming a folded flat blank which can be set up to form a two cell bulk box body comprising:

providing a pair of generally rectangular first flat sheets each scored along spaced parallel score lines to provide first side, end, second side, and center inner walls, with the first side wall having an extended end;

providing a pair of generally rectangular second flat sheets each scored along spaced parallel score lines to provide first side, end, and second side outer walls, with the first side wall having a shortened length and the second side wall having an extended end;

combining and bonding each first flat sheet with a second flat sheet with the end walls of each sheet superimposed and the other portions of each alined to form two duplicate forms A and B;

combining the two duplicate forms end to end with the extended end of the first side of a first flat sheet of form A butting against the end of shortened first side wall of a second flat sheet of form B;

securing the extended end of the second side wall of form A with adhesive over the said butted ends;

applying adhesive to the top surface of the center inner wall of form B and to the extended end of the second side wall of form B;

folding form A along the alined score lines connecting the inner end wall and the second side wall and the outer end wall and the first side wall to superimpose and bond the center walls of forms A and B;

folding form B along the alined score lines connecting the inner end wall and the second side wall and the outer end wall and the first side wall to butt the extended end of the first side wall of form B against the shortened first side wall of form A and to bond the extended end of the second side of form B over the butting ends of the extended end of the first side wall of form B and the shortened first side wall of form A.

whereby there is formed a substantially flat folded blank which can be easily set up into a two cell bulk box body.

* * * * *